United States Patent [19]

Warne

[11] 4,187,164

[45] Feb. 5, 1980

[54] ANODE

[75] Inventor: Michael A. Warne, Brewood, England

[73] Assignee: Marston Excelsior Limited, Wolverhampton, England

[21] Appl. No.: 920,539

[22] Filed: Jun. 29, 1978

[30] Foreign Application Priority Data

Jul. 8, 1977 [GB] United Kingdom ..... 28774/77

[51] Int. Cl.[2] ..... C23F 13/00

[52] U.S. Cl. ..... 204/196; 204/147; 204/197; 204/290 F

[58] Field of Search ..... 204/147, 196, 197, 279, 204/280, 286, 288, 289, 290 R, 290 F

[56] References Cited

U.S. PATENT DOCUMENTS

| | | | |
|---|---|---|---|
| 3,342,716 | 9/1967 | Anderson et al. | 204/196 |
| 3,617,101 | 11/1971 | Anderson | 204/147 X |
| 3,844,921 | 10/1974 | Benedict | 204/196 |

*Primary Examiner*—Arthur C. Prescott

*Attorney, Agent, or Firm*—Cushman, Darby & Cushman

[57] ABSTRACT

A titanium or niobium cathodic protection anode component comprising a strip of metal roll formed to have, in cross-section, a U-shaped portion with a pair of arms extending from the free edges of the U-shaped portion there being a layer of platinum on the convex surface of the spine of the strip, and systems incorporating such anodes.

21 Claims, 16 Drawing Figures

FIG. 1.
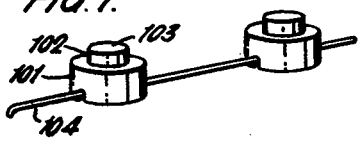
FIG. 2.
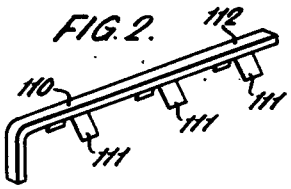
FIG. 3.
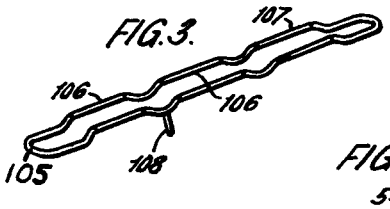
FIG. 4.
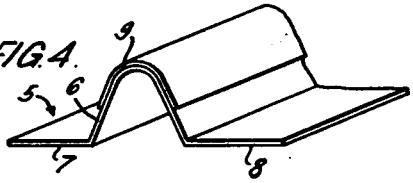
FIG. 5.
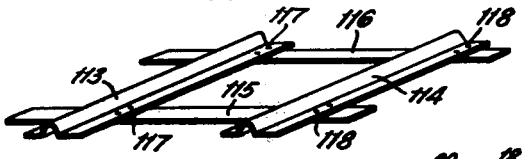
FIG. 6.
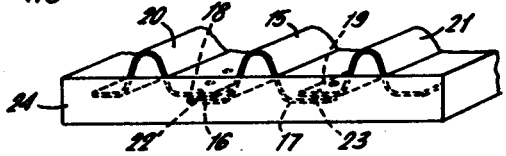
FIG. 7.
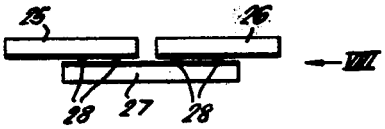
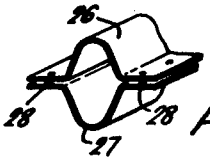
FIG. 8.
FIG. 9.
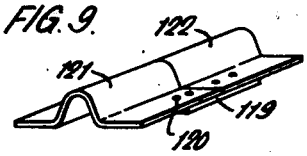

ANODE

BACKGROUND OF THE INVENTION

This invention relates to anode components.

Cathodic protection anodes basically fall into two different types. Consumable anodes function by dissolving in preference to the structure being protected. The consumable anodes are connected to the structure which is normally made of steel and the anode dissolves releasing electrons which pass to the cathodic steel structure to convert the structure into a cathode and thereby protecting it.

The second type of cathodic protection anode is the non-consumable or very slowly consumable anode which is connected to the structure to be cathodically protected through a suitable source of impressed current. Conventionally the second type of anode is formed from titanium or niobium which has a layer of platinum on its surface. There are alternative materials such as magnetite and silicon irons but these do not have the durability of platinised titanium. The physical form of the platinised titanium anodes has normally been a rod of titanium or niobium having an outer layer of platinum or in the form of buttons, discs, plates or tubes of titanium or niobium which are interconnected by means of some suitable electrical connector.

SUMMARY OF THE INVENTION

By the present invention there is provided an anode component for use in cathodic protection comprising a strip of metal selected from the group consisting of titanium, niobium, hafnium, tantalum and alloys of one or more thereof having anodic properties comparable thereto, a substantially central longitudinal portion of the strip having been deformed so as to provide a longitudinally extending spine upstanding from the marginal regions of the strip and the spine having a layer of anodically active material thereon.

The spine may be of substantially U-shaped or V-shaped cross-section. The anodically active material is preferably located on the external surface of the spine. The strip may have been deformed by a roll-forming operation.

The anodically active material may be selected from the group comprising a platinum group metal, a platinum group metal oxide, a conducting platinum group metal compound, lead, a lead alloy and lead dioxide.

The marginal regions of the strip may lie in substantially the same plane. The marginal regions of the strip may be continuous and co-extensive with the spine. The marginal regions may be free of the anodically active material.

The present invention further provides an assembly comprising a plurality of anodes as herein defined in fixed juxtaposition to one another.

The anode component may be in the form of a strip in hoop form. There may be a plurality of hoops coaxially spatially fixed relative to one another.

The component or assembly of components may include means to attach an electrical conductor thereto.

The present invention also provides a cathodic protection anode comprising a component or an assembly of components as herein defined.

The cathodic protection anode may have the marginal regions of the or each strip embedded in a support of electrical insulative material. The present invention further provides a structure having electrically connected thereto via an impressed current source a cathodic protection anode as herein defined. The present invention further provides a ship, the hull of which incorporates a cathodic protection anode as herein defined.

The present invention still further provides a method of cathodically protecting a structure with comprises utilising an anode as herein defined and wherein the anode and the structure are electrically connected to an impressed current source to render the anode anodic relative to the structure.

BRIEF DESCRIPTION OF THE DRAWINGS

By way of example embodiments of the present invention will now be described with reference to the accompanying drawings of which:

FIGS. 1–3 are examples of prior art anodes;

FIG. 4 is a perspective view of an anode component;

FIGS. 5 and 6 are perspective views of a parallel anode assembly;

FIG. 7 is a side elevational view of a tubular anode assembly;

FIG. 8 is an end perspective view of an anode assembly similar to that illustrated in FIG. 7;

FIG. 9 is a perspective view of an end-to-end joined anode assembly incorporating a fish-plate;

DESCRIPTION OF THE PREFERRED EMBODIMENTS

Figure 10:
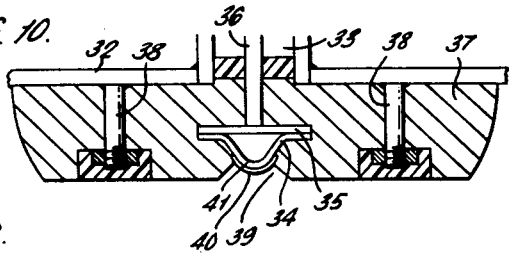
FIG. 10 is a cross-sectional view of an anode assembly installed in the side of a vessel.

The geometrical shape of cathodic protection anodes is very important. Because of the requirements for a high throwing power it has been found that long, thin cathodic protection anodes are more effective than short, fat ones. Long, thin anodes are, however, difficult to mount and it has been the practice to produce anode assemblies which can be mounted in plastics material. Thus the prior art anode assembly illustrated in FIG. 1 has a series of titanium or niobium buttons 101 which have a reduced diameter outer portion 102 having on its outer face a layer of platinum 103. The buttons are connected by suitable wire 104 and are permanently mounted in a layer of plastics material so that the reduced diameter portion 102 protrudes through the plastics material and is the effective anode face. Such a construction is, however, difficult to manufacture because it involves the manufacture of numerous small individual items which each have to be platinised and assembled to form the cathodic protection anode. In an alternative construction it has been proposed to use niobium wires 105 with a series of platinum sleeves 106 disposed at intervals along the length of the wire the wires then being bent into a series of square-wave shapes with the platinum sleeves positioned on the upper horizontal portions 107 of the waves and the wire being embedded in a plastics material such that only the platinised niobium projects through the material. A connector 108 is used to pass electrical current to the wire. This is, however, a difficult assembly to manufacture because of problems of alignment.

A further known form of construction is one in which a rectangle or square cross-section rod 110 (FIG. 2) has welded to it at spaced positions along its lengths a series of bat-wing plates 111. It is, however, difficult to construct this form of anode as the outer surface 112 of the anode has to have platinum on it and it is difficult to join the plates 111 to the rod 110 without damaging the platinum. If the plates are welded on before the rod is platinised it is difficult to satisfactorily apply the platinum to the rod. It has also been proposed to partly coat rods or tubes of titanium with a layer of platinum and embed these rods or tubes in a suitable plastics potting material. Unfortunately, however, to prevent the rods or tubes from coming free of the potting compound they need to be well embedded and this results in too much expensive titanium being positioned below the surface of the potting compound and the overall depth of the assembly being unduly great.

These problems are overcome with the construction of the invention which is shown clearly in FIG. 4.

FIG. 4 shows a roll-formed titanium strip 5 which has a central U-shaped portion or spine 6 and a pair of longitudinally extending arms 7 and 8 integral with the spine 6. A layer of platinum 9 is deposited onto the convex surface of the spine to form the anodically active material. In place of platinum any other suitable anodically active material could be used, such as lead, lead dioxide, rhodium or any other of the platinum group metals such as ruthenium, osmium, iridium and palladium or an oxide of a platinum group metal, in particular ruthenium oxide. The anodically active material can be applied in any manner such as by stopping off the areas which are not to have platinum on their surface and electroplating platinum to the spine.

The most convenient method of manufacturing large quantities of the strip shown in FIG. 4 is by roll-forming or by drawing through a series of suitable dies in a conventional manner. It will be seen in the embodiment illustrated in FIG. 4 that the arms 7 and 8 lie in a common plane. To join two or more components together is simply a matter of positioning them side by side. As shown in FIG. 5 the two components 113 and 114 are positioned over two strips 115 and 116 of titanium and the components are then spot-welded to the strips as at 117, 118 to form the assembly. The assembly can then be potted or encapsulated with only the platinised portions of the spines proud of the encapsulating material.

In an alternative arrangement shown in FIG. 6 the component 15 has its flanges 16 and 17 disposed below flanges 18 and 19 of components 20 and 21. These flanges are then spot-welded together as shown at 22 and 23 and the whole assembly can then be potted or embedded in a suitable plastics material 24 in a conventional manner.

In order to form tubes from the components which make up the invention it is simply a matter of positioning two components 25 and 26 in end-to-end relationship and positioning them back to back with a third component 27. The arms are then spot-welded as at 28 to join the components together to form the tube. It will be seen from FIG. 8 that the tube is in the form of a double-finned tube. Clearly by staggering the components as shown in FIG. 7 the tube can be built up to any length as required. It will be appreciated, of course, that the two components positioned back to back could be of equal length to manufacture a simple tube or the subtotal of the length of the components on each side could be the same so as to form a single straightforward assembly.

To join two lengths of formed component in an end-to-end manner it is simply a question of using a fish-plate 119 spot-welded as at 120 to two components 121 and 122 as is shown in FIG. 9. It will be appreciated that the spot-welding in this case as in all others is well clear of the platinised surface of the spine.

Figure 12:
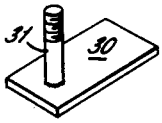
FIGS. 12–16 are perspective views of connector components.
Figure 13:
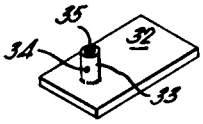
Figure 14:
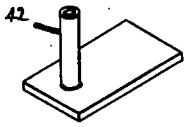

To provide a connector to the anode assembly it is preferred that one of the fish-plates is provided with a stud or tube of titanium which is welded, for example by friction-welding, to the plate. Alternative constructions of connector are shown in FIGS. 12–16. In FIG. 12 it can be seen that the fish-plate 30 has friction-welded to it a screwed rod of titanium 31. An alternative form of construction is illustrated in FIG. 13 in which the plate 32 has welded to it a short hollow cylinder 33. A tapped hole 34 is provided in the cylinder in communication with a bore 35. The wire is inserted into the bore and a suitable screw or bolt is inserted through hole 34 and is tightened onto the wire to form the joint. Alternatively a smaller diameter tube 42 can be welded to the fish-plate as shown in FIG. 14. To provide a suitable connection between a copper wire or other suitable current carrying lead one method would be to etch the inside of the tube or to shot blast the inside to remove excess oxide film. Following this a non-eutectic lead-tin-bismuth-antimony alloy such as "Cerromatrix" Registered Trade Mark can be inserted into the tube, the assembly heated and the wire placed into the molten "Cerromatrix." On cooling "Cerromatrix" has the property that the material expands thereby forming a very tight and positive joint. Conventionally the joint would be potted with a suitable epoxy resin to make it water-tight.

Figure 15:
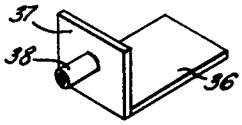
Figure 16:
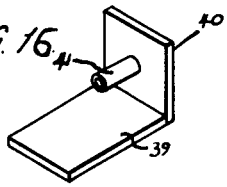

The fish-plate can be provided with a tube parallel to the plate as is shown in FIGS. 15 and 16. In FIG. 15 the fish-plate is made from two items 36 and 37 which are welded together and a tube or other type of connector 38 is welded to the plate 37. Alternatively the fish-plate can be an integral item 39 as shown in FIG. 16, having a portion 40 bent at right angles to the main body of the fish-plate with the tube 41 friction-welded to the portion 40.

A conventional installation utilising the anode construction of the invention is illustrated in FIG. 10. In this embodiment a ship's hull 32 is formed in the conventional manner with an aperture 33. An anode of the invention 34 having a fish-plate 35 welded to it with a lead 36 extending into the hole 33 is embedded in a plastics matrix 37. The matrix is preferably formed from an epoxy resin or other suitable potting compound and is secured to the hull 32 by means of studs 38 welded to the hull in the conventional manner. A trough 39 is left in the insulating material, the width of the trough 39 being slightly less than the area 40 covered by platinum on the spine 41 of the roll-formed anode 34. The spine 41 is protected from abrasion by the insulating material, and the studs are also covered by insulating material.

Although the flanges such as flanges 7 and 8 illustrated in FIG. 2 are shown as being in a common plane, in the embodiment illustrated in FIG. 8 the flanges 30 and 31 can be at an angle to one another so as to permit the section to be joined more easily to a circular cross-section component such as a tube, leg or pipe.

Figure 11:
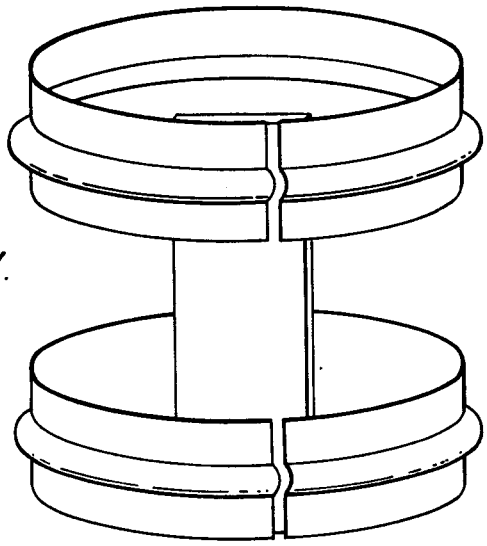
FIG. 11 is a perspective view of a hoop formed anode.

In the embodiment illustrated in FIG. 11, the roll-formed section is bent to form a hoop which can be attached to a pile tube pipe etc. Two or more hoops can be used connected together by suitable strip connectors.

It should be noted that the design of the section, notably the provision of the arms extending sideways, provides particular advantages in two respects:

(a) the section can be very readily joined in a variety of ways to additional similar sections, either longitudinally, in a parallel fashion, or back to back, without the connection means interfering with continuous exposure of the active surface. The joining can be readily extended to a variety of electrical connectors, again without interference with the active surface;

(b) the encapsulation of the anode in a mounting, eg by means of an epoxy or polyester resin composition, is greatly facilitated, on grounds of ease, mechanical integrity and also without hindrance to the exposure of any of the active coating.

One of the more significant advantages of the construction of the invention is that the length to diameter aspect ratio of the cathodic protection anode can be simply varied. Thus more or less of the area of the spine can be coated with a platinum group metal as desired. To increase the aspect ratio the width of the platinum layer or other suitable anodic layer can be reduced and to reduce the aspect ratio it can be increased. Also many different types of construction of anode can be made using the same basic roll-formed shape.

It will be appreciated that instead of a U-shape for the spine a V-shape could be used. U-shapes are, however, preferred in that the peak or point of the V will tend to give high local current densities around the peak whereas with a U-shaped cross-section a more uniform distribution of current is obtained.

I claim:

1. An anode component for use in cathodic protection comprising a strip of metal selected from the group consisting of titanium, niobium, hafnium, tantalum and alloys of one or more thereof having anodic properties comparable thereto, said strip having marginal regions and a substantially central longitudinal portion between said marginal regions, said central portion of the strip having a longitudinally extending spine upstanding from the marginal regions of the strip and the spine having a layer of anodically active material thereon.

2. An anode component as claimed in claim 1 wherein the spine is of substantially U-shaped or V-shaped cross-section.

3. An anode component as claimed in claim 1 or claim 2 wherein the anodically active material is on the external surface of the spine.

4. An anode component as claimed in claim 1 or claim 2 wherein the strip has been deformed by a roll-forming operation.

5. An anode component as claimed in claim 1 or claim 2 wherein the anodically active material is selected from the group consisting of platinum group metals, platinum group metal oxides, conducting platinum group metal compounds, lead and lead alloys and lead dioxide.

6. An anode component as claimed in claim 1 or claim 2 wherein said marginal regions of the strip lie in substantially the same plane.

7. An anode component as claimed in claim 1 or claim 2 wherein said marginal regions of the strip are continuous and co-extensive with the spine and wherein the spine extends along essentially the entire length of the strip.

8. An anode component as claimed in claim 1 or claim 2 wherein said marginal regions are free of said anodically active material.

9. An assembly of a plurality of anode components as claimed in claim 1 or claim 2 arranged in fixed juxtaposition to one another.

10. An anode component as claimed in claim 1 or claim 2 wherein the strip is substantially in the form of a hoop.

11. An assembly of a plurality of components as claimed in claim 10, the components being coaxially, spatially fixed relative to one another.

12. A component as claimed in claim 1 or 2 including means to attach an electrical conductor thereto.

13. A cathodic protection anode comprising a component as claimed in claim 1 or claim 2.

14. A cathodic protection anode as claimed in claim 13 wherein the marginal regions of the strip are embedded in a suport of electrically insulative material so as to leave exposed a continuous strip of anodically active material.

15. A structure having electrically connected thereto via an impressed current source a cathodic protection anode as claimed in claim 13.

16. In a ship, the hull of which incorporates a cathodic protection anode, the improved anode as claimed in claim 13.

17. A method of cathodically protecting a structure which comprises utilizing an anode as claimed in any one of claims 13 or 14 and wherein the anode and the structure are electrically connected to an impressed current source to render the anode anodic relative to the structure.

18. A cathodic protection anode comprising an assembly of components as claimed in claim 9.

19. A structure having electrically connected thereto via an impressed current source a cathodic protection anode as claimed in claim 18.

20. In a ship, the hull of which incorporates a cathodic protection anode the improved anode as claimed in claim 18.

21. A method of cathodically protecting a structure which comprises utilising an anode as claimed in claim 18 and wherein the anode and the structure are electrically connected to an impressed current source to render the anode anodic relative to the structure.

* * * * *